US009295320B1

(12) United States Patent
McManus

(10) Patent No.: US 9,295,320 B1
(45) Date of Patent: Mar. 29, 2016

(54) CLOTHES ATTACHABLE COLLAPSIBLE THEME PARK BEVERAGE HOLDING APPARATUS

(71) Applicant: Robert C. McManus, Bangor, PA (US)

(72) Inventor: Robert C. McManus, Bangor, PA (US)

( * ) Notice: Subject to any disclaimer, the term of this patent is extended or adjusted under 35 U.S.C. 154(b) by 0 days.

(21) Appl. No.: 14/229,804

(22) Filed: Mar. 28, 2014

Related U.S. Application Data

(60) Provisional application No. 61/806,272, filed on Mar. 28, 2013.

(51) Int. Cl.
*A45F 5/02* (2006.01)

(52) U.S. Cl.
CPC . *A45F 5/021* (2013.01); *A45F 5/02* (2013.01); *A45F 2200/0583* (2013.01)

(58) Field of Classification Search
CPC ... A45F 5/021; A45F 5/02; A45F 2200/0583; B60N 3/10; B62B 2202/023
USPC ..... 224/148.1–148.7, 163, 270, 452, 224/454–456, 524, 528, 561, 564, 660, 224/663–684, 926; 248/311.2; D3/202; D7/620
See application file for complete search history.

(56) References Cited

U.S. PATENT DOCUMENTS

| | | | | |
|---|---|---|---|---|
| 4,708,273 | A | 11/1987 | Grant | |
| 4,754,903 | A * | 7/1988 | Dennis | 224/148.5 |
| 5,280,870 | A | 1/1994 | Chick | |
| 5,390,838 | A * | 2/1995 | Jafarkhani | 224/148.4 |
| 5,522,527 | A * | 6/1996 | Tsai | 224/414 |
| 5,944,238 | A | 8/1999 | Stark | |
| 6,457,616 | B2 | 10/2002 | Gagne | |
| 7,712,645 | B2 * | 5/2010 | Calkin | 224/649 |
| 8,573,553 | B2 * | 11/2013 | Stephan | 248/311.2 |
| 2007/0090136 | A1 | 4/2007 | Stowell | |
| 2010/0032461 | A1 * | 2/2010 | Kriner | 224/163 |

* cited by examiner

*Primary Examiner* — J. Gregory Pickett
*Assistant Examiner* — Scott McNurlen
(74) *Attorney, Agent, or Firm* — Clinton H. Wilkinson; Charles A. Wilkinson

(57) ABSTRACT

A collapsible beverage container support apparatus including a back panel, a base pivotally connected to the back panel, a clip mechanism for securing the support apparatus to a user's belt or other clothing item, a beverage support bracket for engaging the side walls of a beverage container, and a support arrangement for transferring a portion of the weight of the beverage container away from the base panel.

14 Claims, 7 Drawing Sheets

CLOTHES ATTACHABLE COLLAPSIBLE THEME PARK BEVERAGE HOLDING APPARATUS

FIELD OF THE INVENTION

The present invention generally relates to portable beverage holders, and more particularly, to a beverage container holder assembly that easily and conveniently fastens to a person's belt or clothing to carry a beverage container, and which is fully collapsible when not in use.

BACKGROUND OF THE INVENTION

The handling of drink containers, particularly at amusement parks, carnivals, sporting events, and the like pose significant problems to the consumer. If the person is moving from one location to another and leaves the beverage behind, it becomes necessary to return to the location the beverage was left each time he or she wishes to imbibe.

In public areas (amusement parks, carnivals, etc.) the usual practice forces the consumer to hand-carry a beverage which is awkward, restrictive, and potentially messy if the beverage should spill. Hand-carrying a beverage requires the constant attention of the person carrying the beverage; therefore, the enjoyment or ability to participate in many activities is greatly diminished. Other common methods or article carrying apparatuses are not well suited for beverage carrying purposes. For example, a person may not wish to carry a can or a lidded cup in his or her clothing pocket as there may be a risk of spillage, particularly if the can has been opened or the lid on the cup is not securely fastened. A person may also not wish to carry the beverage in a purse, backpack, or the like, or article carriers of this kind may be too full to accommodate a beverage container.

The patent literature describes a number of clothes-attachable holders that are used to hold a variety of items. For example, a device described in U.S. Pat. No. 4,708,273, issued on Nov. 24, 1987 to B. T. Grant, is capable of carrying an open beverage container on a person's belt. The device comprises a structure for receiving an open drink container in a supporting relationship so that the container is maintained in a substantially upright condition and can be withdrawn to consume a drink therein; and a structure for attaching said container receiving structure to a belt. The container receiving structure and the belt attaching structure join together as a one-piece molded structure. As such, a drawback of this device is that it is not capable of being transformed or folded up into a more portable shape or size that is more suitable for being carried in a pocket or purse.

U.S. Pat. No. 5,280,870 issued on Jan. 25, 1994 to A. L. Chick describes a holder for a beverage container including a vertical back plate having arms for engaging the side wall of a beverage container, a hinged base member pivotally attached to the back plate and including a base plate and first and second sidewalls attached to the base plate, and a collapsible bracket which can be engaged with the base member in an upright position or stored within the holder when in its collapsed configuration.

U.S. Pat. No. 5,944,238 issued on Aug. 31, 1999 to H. V. Stark describes a clothes-attachable beverage can holder comprising an open fronted holder body with a vertically extending back portion and a horizontal base portion on which a can may be rested. A pair of resilient arms extend from the back portion to clasp the can and have spaced apart front ends forming a gap into which a can may be forced by an at least partially sidewise movement of the can. A lid attached to the holder by a flexible lid retainer has a circular lip proportioned to snap engage on the top of a beverage can and acts to seal the opened can.

U.S. Pat. No. 6,457,616 issued on Oct. 1, 2002 to R. G. Gagne discloses a belt clip mounted beverage holder comprising a hands-free holder assembly which supports a beverage container in an easily accessible location. The holder assembly employs a spring loaded clip to fasten and secure the body portion of the holder to a person's belt or waistband. A pivotally mounted bracket disposed near the base of the body portion receives a beverage container. The bracket is designed to assume a pendular motion which allows the wearer of the holder assembly to move about in an unrestricted manner.

U.S. Patent Application Publication No. 2007/0090136 published on Apr. 26, 2007 to J. D. Stowell discloses a belt buckle incorporating a collapsible cup holder, wherein the cup holder is hidden in the passive configuration, the belt buckle having a cover member that pivots downward to form a base to support a beverage container, and a retainer that pivots up to retain the body of the beverage container.

A drawback of known body supported beverage container carrying devices is that the more rugged devices capable of supporting larger containers are not easily stored when not in use, and therefore are in some cases nearly as inconvenient to hold or carry when not in use as a beverage container. On the other hand, collapsible beverage container carrying devices are generally of a rather inadequate construction for supporting the weight of larger containers filled with a liquid beverage. For example, an average sized beverage holder or cup holds between sixteen and sixty-four ounces. Thirty two ounces of water weighs about 4.17 pounds, all of which weight typically is supported on a bottom support panel, which places a great deal of stress on the hinge or connection means between the bottom support panel and a back panel. What is needed therefore is a beverage container holder having a reinforced base portion suited for repeatedly supporting the weight of large drinks or beverage containers that is also foldable into a compact configuration and can be easily carried in a standard size pocket or purse when not in use.

BRIEF SUMMARY OF THE INVENTION

The present invention is directed to a clothes attachable collapsible theme park beverage holding apparatus having a means for transferring the weight supported by the apparatus away from the base panel or section so that the apparatus is capable of repeatedly carrying and supporting the substantial weight of large beverage containers without breaking. The base portion of currently available beverage and cup holders only include a single panel, which is not reinforced by an additional panel or other means. In addition, the beverage holding apparatus is foldable into a compact configuration such that it can be easily carried in a pocket or purse when not in use. In one embodiment of the present invention, the apparatus includes a back panel, a lower base panel hingedly connected to the back panel near one end, an upper base panel hingedly connected to the lower base panel, a beverage apparatus support clamp mechanism attached to the back panel in a spaced apart position from the lower base panel, and a clip mechanism for securing the beverage holding the apparatus to a belt or clothing of a person during use of the invention. When folded for storage, the upper and lower base panels are secured side-by-side with the back panel. To use the presently described embodiment, the lower base panel is pivoted so that it is substantially perpendicular to the back panel, while the upper base panel is pivoted to a position adjacent the upper surface of the lower base panel and is secured directly to the back panel using the securing means. In addition, the beverage support clamp mechanism is pivoted upwardly, and the apparatus is secured to the user's belt or other clothing using the clip mechanism. A beverage container is received by the apparatus with the bottom of the container resting on the upper base panel and the other end or neck of the beverage container being gripped by the support clamp mechanism. The reinforced double layer base panel easily supports the weight of the beverage container, which weight is redirected from the base panels through the securing means to the back panel, rather than all of the weight being centered on a hinge or other connection between the lower base panel and back panel as would occur without the upper base panel. The belt clip mechanism also includes in one embodiment a swivel connection to the base panel which allows the beverage container to be maintained in a substantially upright position without limiting the manner of movement of the user. In another embodiment, the apparatus is provided with a base panel and one or more cable members connected between the back panel and base panel of the apparatus, which cable members in a similar manner serve to reduce the amount of weight of a beverage supported by the base panel of the apparatus, redistributing this weight from the base panel to the back panel and ultimately dispersing such forces through the buckle member attached to the user.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
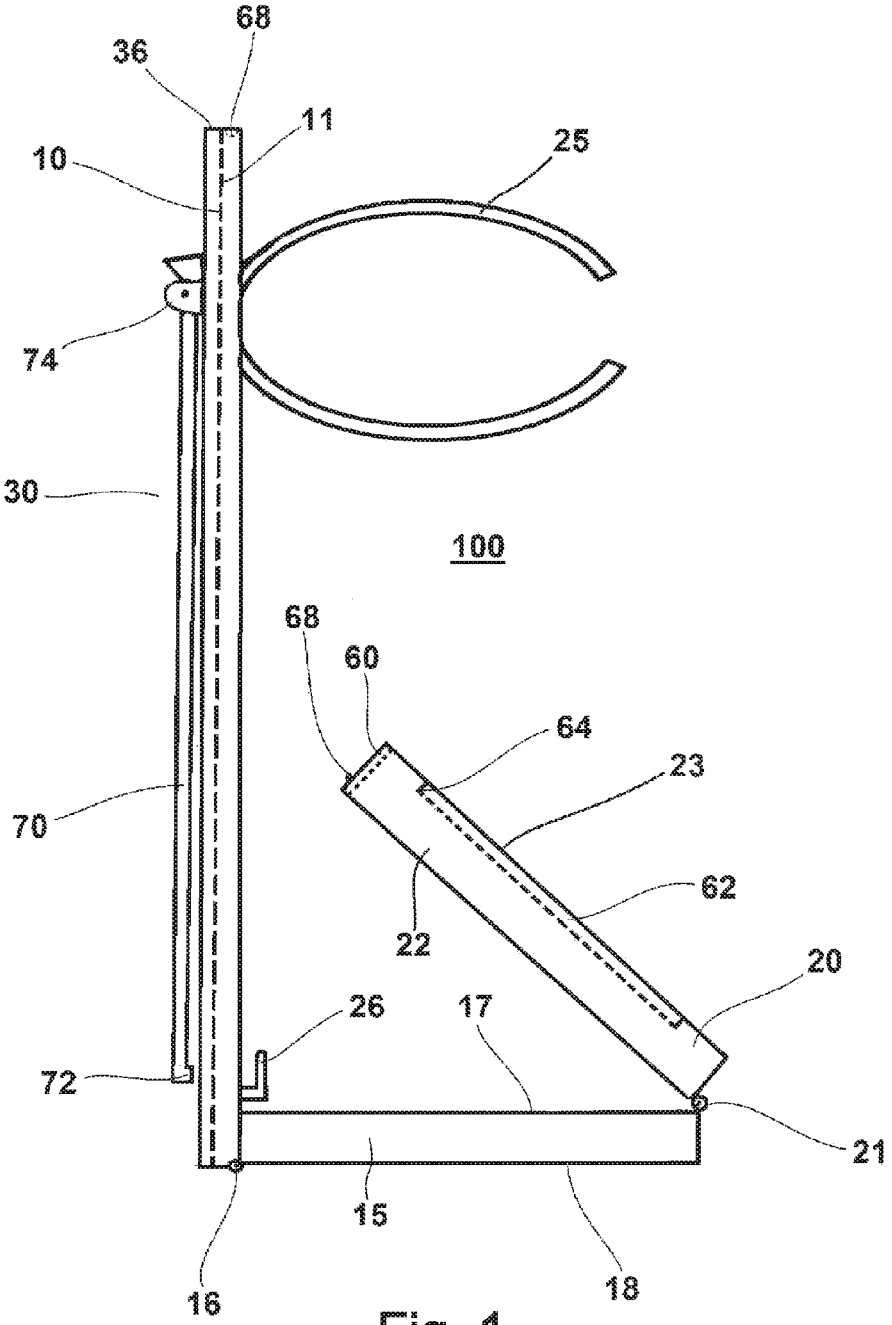
FIG. 1 is an elevation side view of an embodiment of the beverage holding apparatus of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. The components in the drawings are not necessarily drawn to scale, the emphasis instead being placed upon clearly illustrating the principles and manner of use of the invention. Moreover, in the drawings, like reference numerals designate corresponding parts throughout the several views. Wherever possible, the same reference numbers are used throughout the drawings to refer to the same or like elements of an embodiment.

FIGS. 1-6 illustrate an embodiment of the beverage container holding apparatus of the present invention, while FIGS. 7-15 illustrate another embodiment. As shown in FIG. 1, beverage holding apparatus 100 generally includes an elongated vertical back support panel 10 having a front surface 11 (shown in dotted lines in FIG. 1; see also FIG. 2) and a rear surface 12 (see also FIG. 4) as well as a longitudinal axis, an inner base panel 15 which is pivotally connected to back panel 10 by hinge device 16 and has an upper surface 17 and a lower surface 18, and an outer base panel 20 which is pivotally connected to inner base panel 15 on the end opposite hinge device 16 by another hinge device 21 and includes a bottom surface 22 and top beverage container support surface 23. In the illustrated embodiment, the back support panel 10, and first and second base panels 15 and 20 are all generally rectangular in shape, with each panel being bounded by four straight edges, and with base panels 15 and 20 except as described below being approximately congruent to each other, although it will be understood that one or more corners of the panels may be rounded slightly to eliminate any sharp edges. Hinges 16 and 21 may be either a single hinge or a plurality of two or more spaced apart hinges. In one embodiment, panels 10, 15 and 20 are formed of a plastic material by injection molding, which plastic material may include, but is not limited to plastic materials such as polystyrene, SAN, ABS, PPO, nylon, polypropylene, polyethylene, PET, polycarbonates, acrylics and PVC among others. In addition, the plastic material may be provided with specific coloration in conformance with the specific demands of the customer. In other embodiments, the panels and other parts of apparatus 100 can be made of other suitable materials such as metal and composite materials, and one or more of panels 10, 15, and 20 may be provided in a different shape.

Hinge 16 allows inner base panel 15 to pivot between at least a first position in which the upper and lower surfaces 17 and 18 of inner base panel 15 and front surface 11 of back support panel 10 are oriented substantially in parallel, and a second position in which surfaces 17 and 18 of inner base panel 15 are substantially perpendicular to front surface 11 of back support panel 10. In addition, hinge 21 allows outer base panel 20 to pivot between at least a position in which the surfaces 17 and 18 of panels 15 and surfaces 22 and 23 of panel 20 are in an adjacent and substantially coplanar relationship (see FIG. 3) and another position in which upper surface 17 of inner base panel 15 and bottom surface 22 of outer base panel 20 juxtaposed next to each other, with bottom surface 22 of outer base panel 20 essentially resting in close proximity to or stacked on top of inner base panel 15. A foldable and adjustable container support bracket 25 is pivotally attached to back support panel 10 so as to extend outwardly from front side 11. In addition, a belt fastening mechanism 30 is secured to the rear side 12 of back support panel 10. One or more outwardly extending L-shaped tabs 26 are also secured to back support panel 10 near the lower end of front surface 11, which tabs as explained in detail below serve as a latching means for securing outer base panel 20 directly to back panel 10 when device 100 is in a use position.

Figure 2:
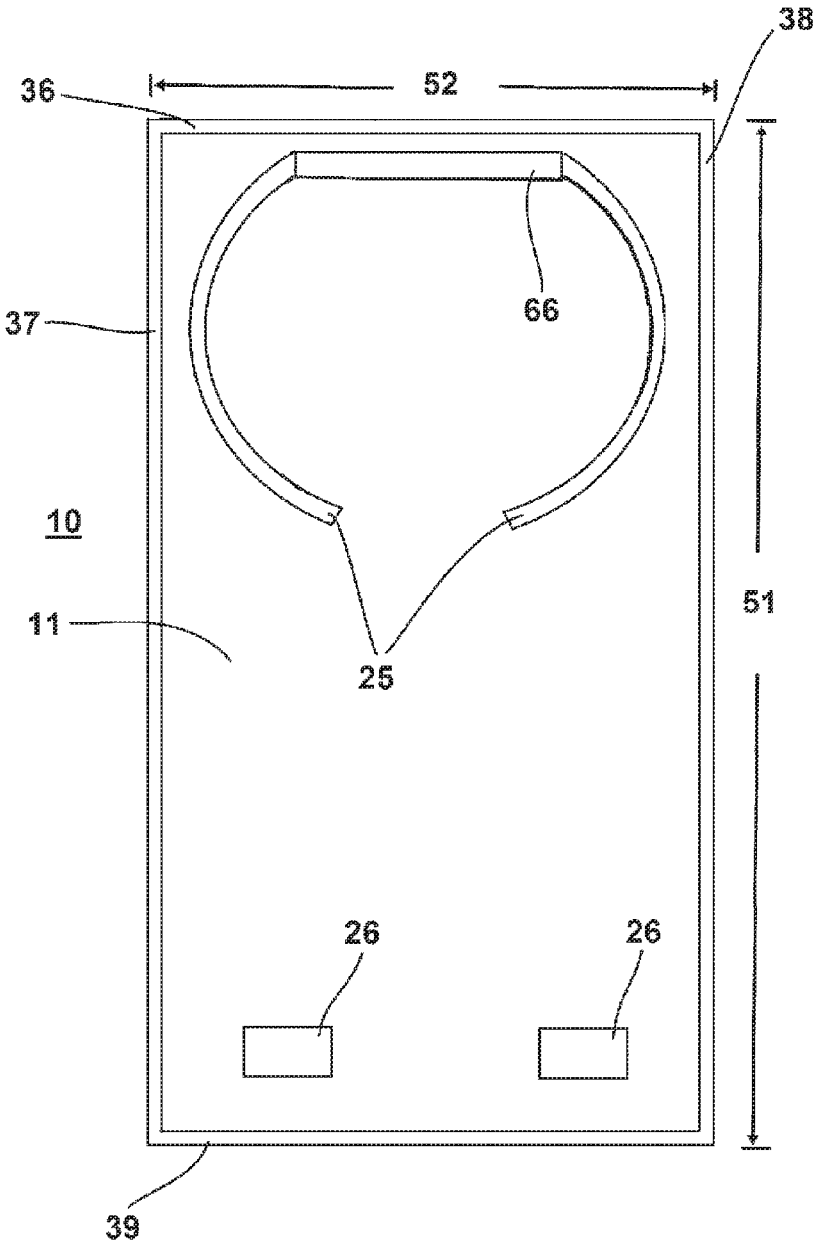
FIG. 2 is an elevation front view of the back panel of the beverage holding apparatus embodiment shown in FIG. 1.
Figure 5A:
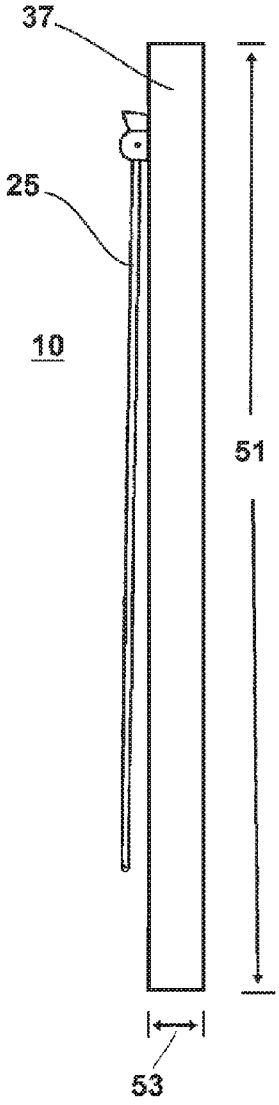
FIGS. 5*a* and 5*b* are elevation side views of the back panel of the beverage holding apparatus embodiment shown in FIGS. 1-4.
Figure 5B:
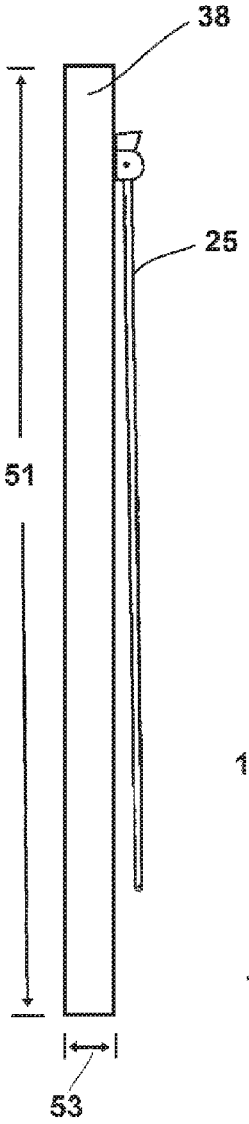

FIG. 2 illustrates the front surface 11 of back panel 10. In the illustrated embodiment, back panel 10 includes a top side wall 36, first lateral side wall 37, second lateral side wall 38, and bottom side wall 39 which are connected extending outwardly at a right angle from the peripheral edges of the back panel 10, and with the ends of adjacent side walls forming corners, resulting in back panel 10 having a shallow box-like configuration (see FIG. 2). In a preferred embodiment, as shown in FIGS. 2 and 5, back panel 10 has a height 51 of about 7½ inches, a width 52 of about 4 inches, and side walls 36, 37, 38, and 39 have a width 53 of about ⅜ inches. It will be understood that these dimensions are merely exemplary of one embodiment of the invention, and that back panel 10 and side walls 36, 37, 38, and 39 may have different dimensions while still falling within the intended scope of the present invention.

Figure 3:
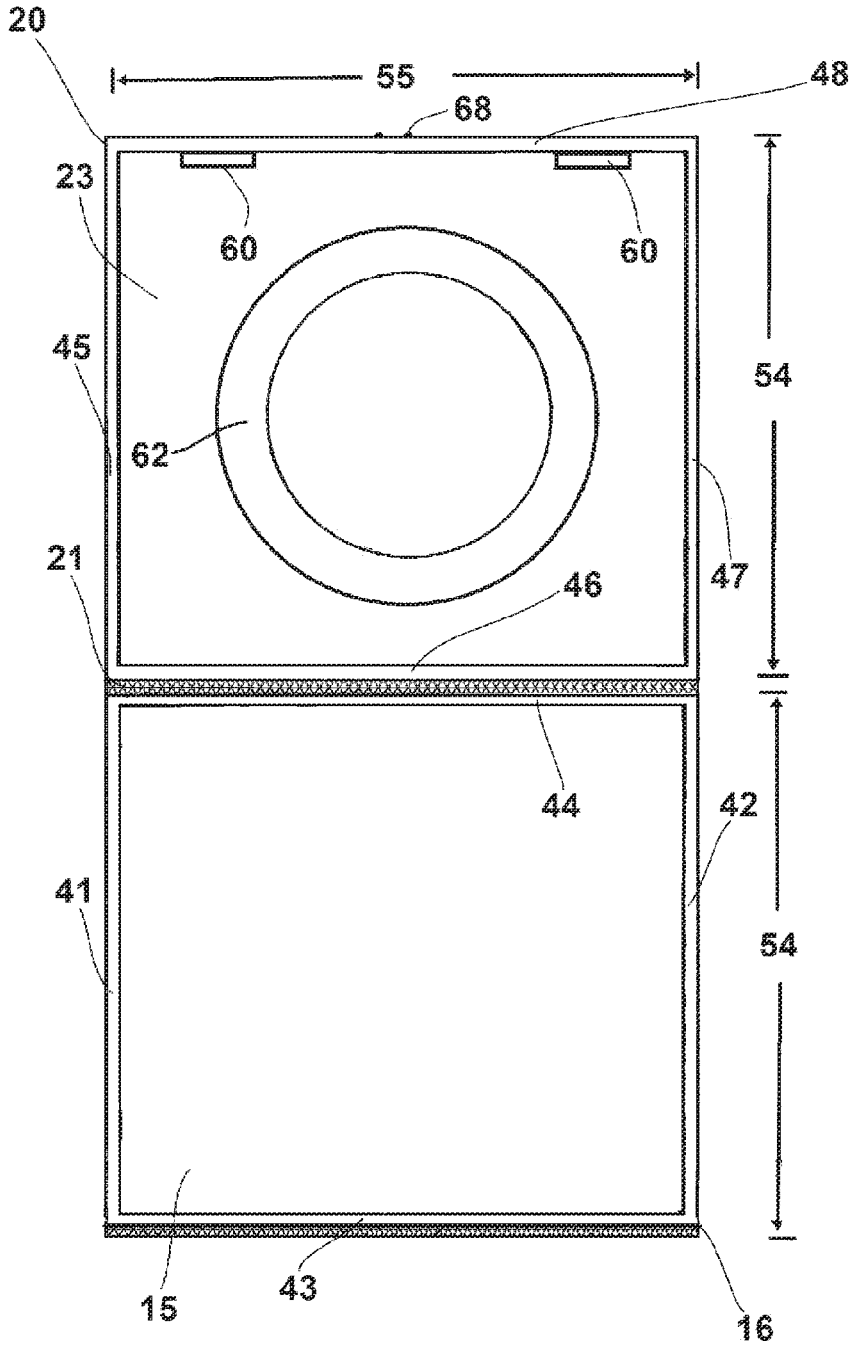
FIG. 3 is an elevation top view of the base panels of the beverage holding apparatus embodiment shown in FIG. 1.
Figure 4:
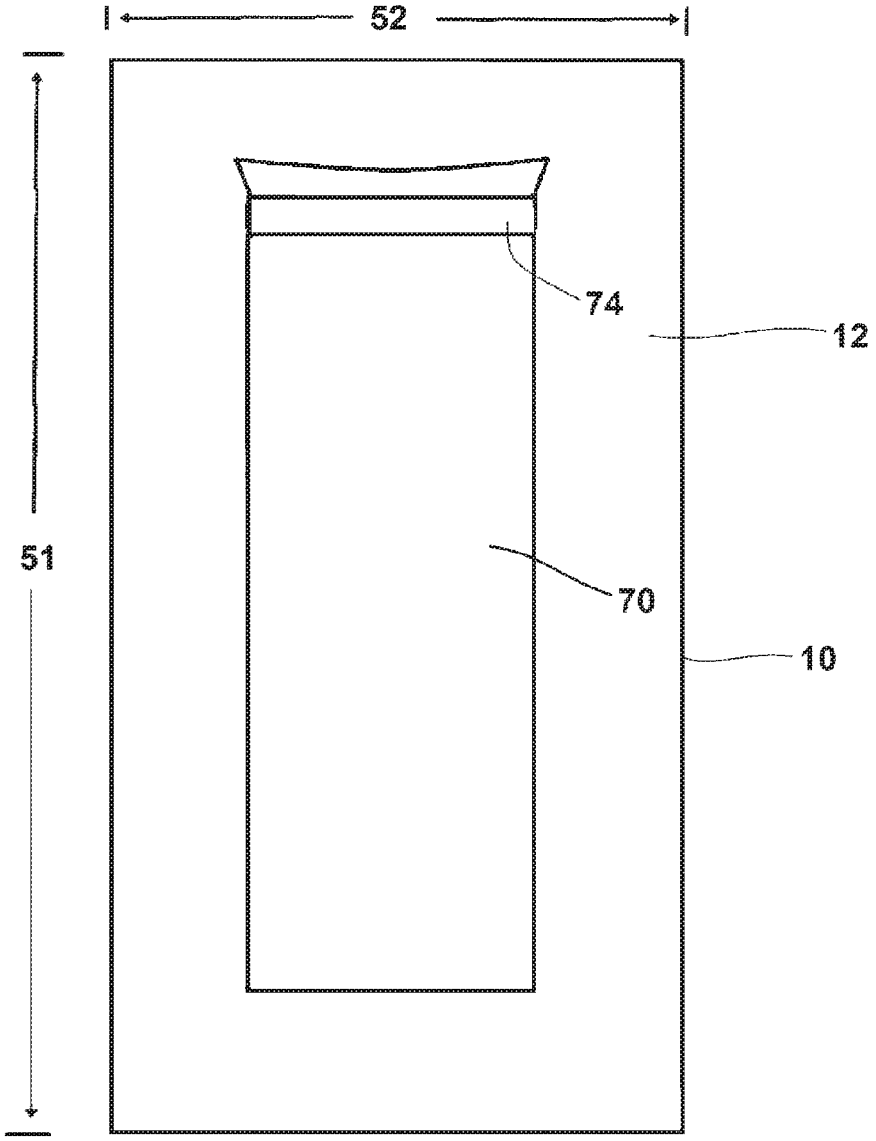
FIG. 4 is an elevation back view of the beverage holding apparatus embodiment shown in FIG. 1.
Figure 6A:
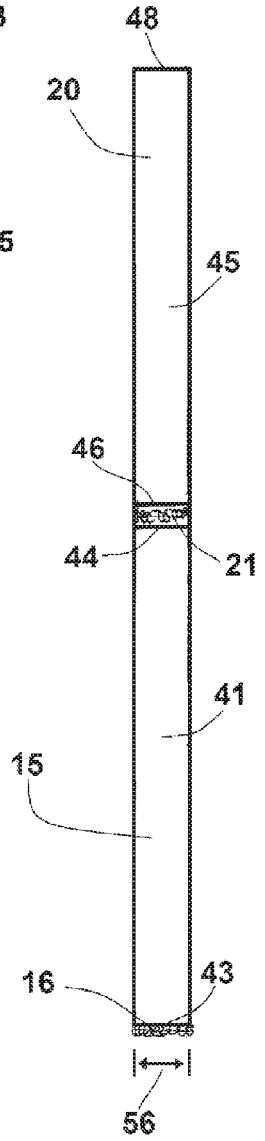
FIGS. 6*a* and 6*b* are elevation side views of the base panels of the beverage holding apparatus embodiment shown in FIGS. 1-5.
Figure 6B:
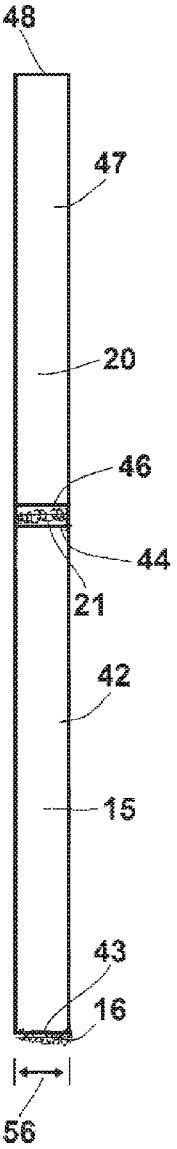

Referring now in particular to FIGS. 3 and 6, side walls 41, 42, 43, and 44 of inner base panel 15 are connected extending outwardly at a right angle from the peripheral edges of panel 15, with the ends of adjacent edge panels being connected and forming corners. In another embodiment, inner base panel 15 may be a solid flat panel, while in still another embodiment inner base panel 15 may include first and second flat panels which extend axially between connecting outer edges of side walls 41, 42, 43, and 44, or may have reinforcing ribs throughout its structure. However, any such alternative structures must make provisions such as by having slots or a cavity which accommodates outwardly extending tabs 26 when inner base panel 15 is pivoted into a closed position parallel to rear base panel 10 as explained below. It will be noted that while the function of inner base panel 15 is to serve as a rigid support structure, it will be understood that in the presently described embodiment the inner base panel is not designed for beverage containers to be placed directly on upper surface 17.

Outer base panel 20 in one embodiment similarly has four side walls 45, 46, 47 and 48 extending outwardly from the upper surface 23 with their ends forming corners, providing a shallow box-like structure. In a preferred embodiment, as best shown in FIGS. 2 and 5, back panel 10 has a height 51 of about 7½ inches, a width 52 of about 4 inches, and edge panels 36, 37, 38, and 39 have a width 53 of about ⅜$^{th}$ inches. In addition, in the embodiment shown in FIGS. 3 and 6, together inner and outer base panels 15 and 20 have about the same dimensions as the back panel 10 when positioned with the outer surfaces of side panels 44 and 46 side by side or adjacent to each other. More particularly, each base panel 15 and 20 has a length 54 of about 3¾ inches, a width 55 of about 4 inches and the side panels have a width 56 of about ⅜ inches. In another embodiment, the combined dimensions of lower and upper base panels 15 and 20 are slightly less than the dimensions of back panel 10 such that when folded into a storage position lower and upper base panels 15 and 20 fit at least partially within side walls 36, 37, 38 and 39 of the rear panel 10.

Referring again to FIG. 1, outer base panel 20 folds on hinge 21 over and against the inner base panel 15, and is securable in this position by a connection means. More particularly, in the illustrated embodiment one or more slots 60 (see also FIG. 3) are provided or formed in outer base panel 20, which slot or slots 60 are aligned with and receive tab or tabs 26 on back panel 10 when inner base panel 15 is pivoted to a position substantially perpendicular to back panel 10, and outer base panel 20 is pivoted on top of inner base panel 15. Upon tabs 26 being received in slots 60, the back panel 10 becomes directly connected to outer base panel 20, such that each panel 10, 15, and 20 is connected to each other panel 10, 15, and 20, creating a rigid structure. Connecting and locking the outer base panel 20 using this latching means also secures both base panels 15 and 20 in a substantially perpendicular position adjacent the lower edge of the back panel 10, thereby stabilizing the base panels 15 and 20 in a generally stationary and horizontal position so that a beverage can be placed above said panels 15 and 20. Folding the outer base panel 20 over and locking it using the latching means 26 superimposes it over the inner base panel 15. In another embodiment, tabs 26 may be provided on an edge of upper base panel 20 and aligned to be inserted in associated slots or behind a lip member on front surface 11 of base panel 10. Other means for connecting upper base panel 20 directly to rear panel 10 may be substituted while stilling falling within the scope of the invention.

As shown in FIGS. 1 and 3, in a preferred embodiment, a flat depression or indentation 62 having inner side walls 64 is located on upper side 23 of the outer base panel 20, which side 23 faces upward when the base panels 15 and 20 are in a locked beverage support position. In use, the bottom portion of a beverage receptacle rests on the surface of the indentation 62, and inner side walls 64 of the indentation 62 help restrain the beverage receptacle from sliding back and forth on upper surface 23 of base panel 20, thereby aiding in preventing the receptacle from slipping from the holder 100, or further preventing spillage of the beverage. As shown in FIG. 3, the indentation 62 may have a round or elliptical shape, and in one embodiment has a diameter of about 3 inches and a depth of about ¼ inches.

It will be understood that indentation 62 is not limited to having a round or elliptical shape, and may take on any other form suitably shaped for bounding or restraining the bottom portion of any type of a beverage receptacle. In an alternative embodiment, instead of an indentation, a middle portion of upper surface 23 of the outer base panel 20 can be completely hollowed through, forming a hole or sectional cutout through the panel 20. In use, the inner side walls created by the hole enclose and bound the bottom portion of a beverage receptacle, thereby preventing the receptacle from slipping from the holder 100, further preventing spillage of the beverage. Like the indentation 62 described above, the hole is not limited to being of circular or elliptical shape, and may be a cutout of any shape suitable for bounding or restraining the bottom portion of a beverage receptacle.

In addition, as best shown in FIG. 2, a pair of opposed arms 25 are pivotally secured to front side 11 of the back panel 10, each of said arms 25 connecting to the back panel 10 by preferably spring loaded hinges (not shown) housed in sleeve 66 connected to front surface 11 of back panel 10. Arms 25 are located alongside each other in a spaced-apart arrangement near the end of back panel 10 opposite tabs 26, which is generally considered the upper end of front panel 10. The hinges connecting each arm 25 to back panel 10 allow each arm 25 to pivot in a side to side, or back and forth, direction about sleeve 66. More particularly, arms 25 are movable between a folded position as shown in FIG. 2 in which the arms are pivoted downwardly towards front surface 11 of back panel 10, and a use position shown in FIG. 1 in which arms 25 extend outwardly substantially horizontally from front side 11 of back panel 10. This configuration allows the holder 100 to be able to accommodate a wider range of sizes and/or shapes of beverage containing receptacles because the hinges 64 allow the arms 25 to be adjustable in a back and forth direction.

Arms 25 are configured to embrace the side walls of a beverage containing receptacle, generally about the neck or upper end of the receptacle. The arms 25 can have a generally curved shape and can be generally symmetrical, with the arms 25 forming a generally double-convex configuration to each other, adapting the holder 100 for receiving cylindrically shaped beverage receptacles such as soda cans or mugs. However, the present invention is not limited to having curved or double-convex configured arms, or symmetrical arms, and thus can have arms conforming to embrace any shape or type of beverage containing receptacle. In a preferred embodiment, the hinges of the arms 25 are spaced about 2 inches apart from each other. Each arm 25 also has a length of about 3 inches, whereby such length refers to how far the arm 25 can extend from the back panel 10. Additionally, in one embodiment each arm 25 has a width or thickness of about ¼th inches.

Belt fastening mechanism 30 has a tensioned clip member 70 of a type designed to be inserted behind a conventional garment belt or clothing item such as the pant waist of the user. A wedge-shaped tab 72 may be provided on one end of clip member 70 which after the clip member is passed behind the belt fits underneath the belt and aids in holding the clip member in position. Clip member 70 is connected to the rear surface 12 of back panel 10 by a connecting means, which as illustrated in FIG. 1 includes holding members 74 to which the clip member is pivotably connected. In one implementation clip member 70 includes a shaft section at one end of the clip member which is connected between holding members 74 in another shaft. It is preferred that a tension inducing member such as a compression coil spring be included as part of the connecting means which causes clip member 70 to be continually urged toward back panel 10. In addition, the clip mechanism may be swivelably connected to back panel 10 by a swivel hinge, so that in use the beverage holder apparatus 100 is free to swivel in relation to the clip member 70 so that as the user changes his body position such as moving between a sitting, standing, or leaning position, the beverage apparatus 100 can be maintained in a relatively level or upright position so that the beverage container is less likely to spill. In another embodiment, belt fastening mechanism 30 may be comprised of a U-shaped metal piece having a first section which is secured directly to rear surface 12 of back panel 10, and a second section which serves as the clip member, whereby the tension on the clip member is a result of curvature of the metal.

Beverage holding apparatus 100 is easily foldable to be carried in a pocket or purse when not in use as a result of its slim configuration in which base panels 15 and 20 are pivoted into a position aligned with and secured to back panel 10. A mechanical latch mechanism 68 of a known type is provided in one embodiment on the upper end of base panel 10, preferably on top side wall 36, while a mating fastener is provided on outer side wall section 48 of outer support panel 20. When it is desired to use apparatus 100 to support a beverage, the latch mechanism is activated to release support panels 15 and 20 from back panel 10. Lower support panel 15 is then pivoted on hinges 16 to a position in which it is essentially perpendicular to back panel 10. In addition, upper support panel 20 is pivoted on hinges 21 to a position on top of lower support panel 15, which tabs 26 are inserted in slots 60 on upper support panel 20. Provision of the connected upper and lower support panels greatly increases the amount of weight apparatus 100 can hold, which is particularly useful in holding theme-park sized beverage containers designed to hold 32, 48, or 64 ounces of liquid or even greater amounts.

FIGS. 7-13 illustrate another embodiment of the collapsible beverage holding apparatus of the invention. Apparatus 200 generally includes a back panel 82 having a front surface 83 and a rear surface 84, and a base panel 86 which is pivotally connected to back panel 82 by a hinge connection 88, and having a beverage support surface 90 and an opposite surface 92. In addition, a beverage container support bracket or member 94 is pivotally attached along the front surface 83 of the back panel 82, and a fastening member 96 extends outwardly from the rear surface 84 of the back support panel 82 for securing holder 200 to a belt or the like of a user. In the illustrated embodiment, the back panel 82 and base panel 86 are generally rectangular in shape, although it will be understood that one or more corners of the panels are rounded slightly to eliminate any sharp edges.

Panels 82 and 86 as well as support member 94 and fastener 96 in one embodiment are formed of a plastic material by injection molding, which plastic material may include, but is not limited to plastic materials such as polystyrene, SAN, ABS, PPO, nylon, polypropylene, polyethylene, PET, polycarbonates, acrylics and PVC among others. In addition, the plastic material may be provided with specific coloration in conformance with the specific demands of the customer. In other embodiments, the panels and other components of apparatus 200 can be made of other suitable materials such as metal and composite materials, and one or more of the panels may be provided in a different shape or with different dimensions. Hinge connection 88 allows base panel 86 to pivot between at least a first storage position in which the beverage support surface 90 and front surface 83 of back support panel 82 are oriented substantially in parallel (see FIG. 14), and a second use position in which beverage support surface 90 of base panel 86 is at substantially a right angle with respect to front surface 83 of back support panel 82 (see FIG. 7). Beverage support member 94 is similarly pivotable between a storage position (see FIG. 14) and use position (see FIGS. 7-8 and 15).

In the illustrated embodiment, back panel 82 includes an upper side wall 102, first lateral side wall 104, second lateral side wall 106, and a lower side wall 108, which are connected extending outwardly at a right angle from the peripheral edges of the back panel 82, and with the ends of adjacent side walls forming corners, resulting in back panel 82 having a shallow box-like configuration. Side walls 102, 104, and 106 have a similar width, while side wall 108 may be slightly abbreviated in order to accommodate pivoting movement of panel 86 (see FIG. 10). In one embodiment, back panel 82 has a height of about 6.25 inches, a width of about 4 inches, and side walls 102, 104, and 106 have a width of about 0.375 inches. Base panel 86 includes a front side wall 110, a rear side wall 112, a first side wall 114, and a second side wall 116 which form an outer wall extending outwardly from beverage support surface 90. Corners 118 and 120 are cut away to accommodate arms 122 and 124 on the lower ends of back panel 82. Arms 122 and 124 contain inwardly facing opposite apertures, in which tabs 126 and 128 (see FIG. 11) on base panel 86 are inserted to pivotally connect base panel 86 to back panel 82. In one embodiment, arms 122 and 124 and tabs 126 and 128 are integrally formed with back panel 82 and base panel 86, respectively. In addition, the rear edge 130 of base panel 86 may be rounded also to accommodate a pivoting motion with respect to back panel 82.

Figure 7:
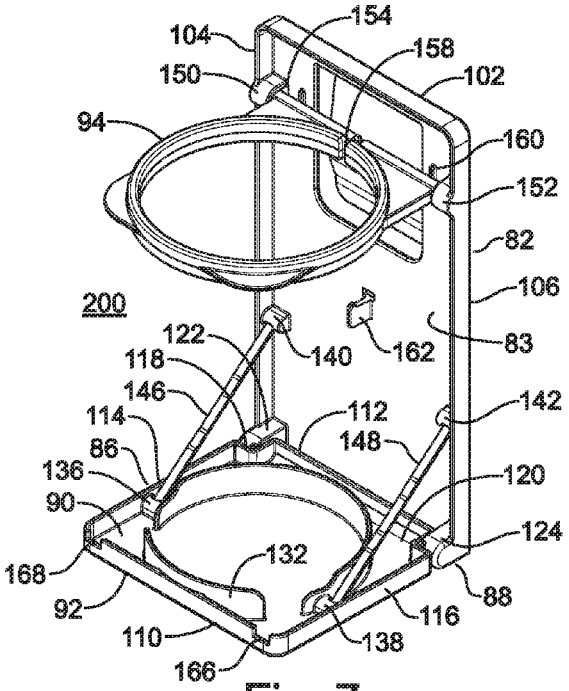
FIG. 7 is a perspective view of another embodiment of the beverage holding apparatus of the present invention.
Figure 8:
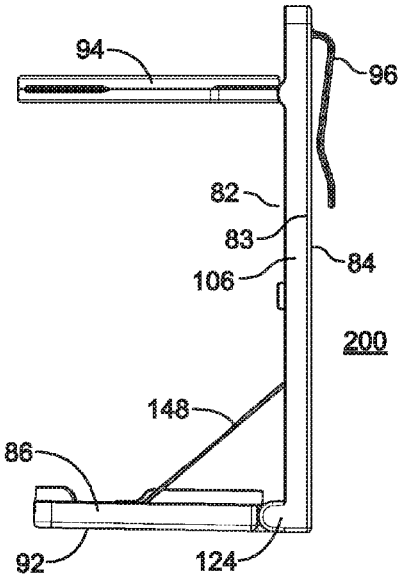
FIG. 8 is a side elevation view of the embodiment in FIG. 7.
Figure 9:
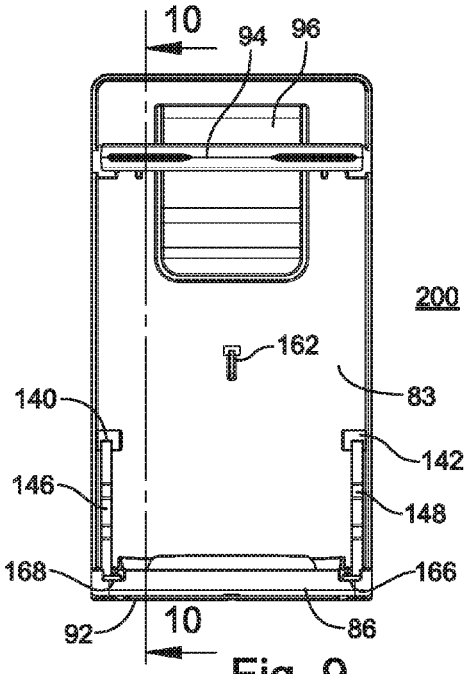
FIG. 9 is a front elevation view thereof.
Figure 10:
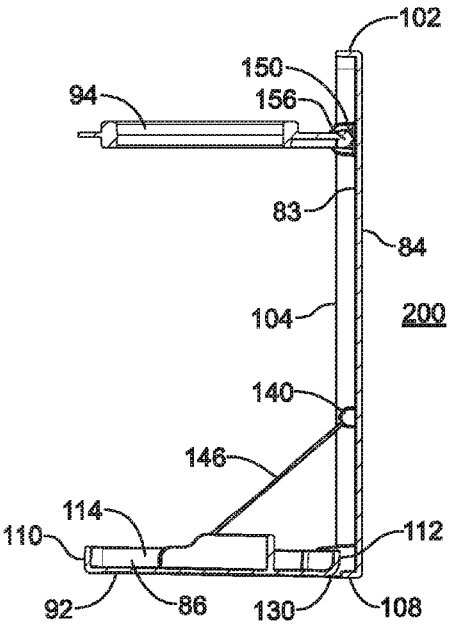
FIG. 10 is a cross-sectional view taken along line A-A in FIG. 9.
Figure 11:
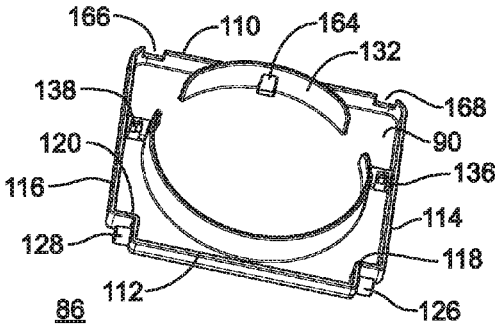
FIG. 11 is a perspective view of the base panel of the embodiment shown in FIGS. 7-10.
Figure 12:
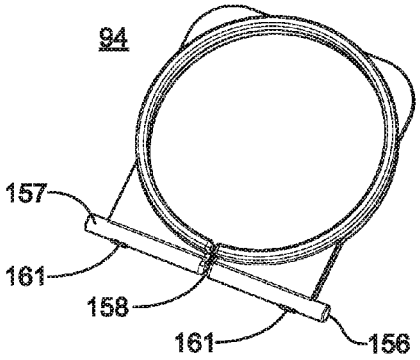
FIG. 12 is a perspective view of the beverage container holding member.
Figure 13:
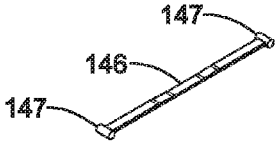
FIG. 13 is a perspective view of an embodiment of the base panel support cable.
Figure 14:
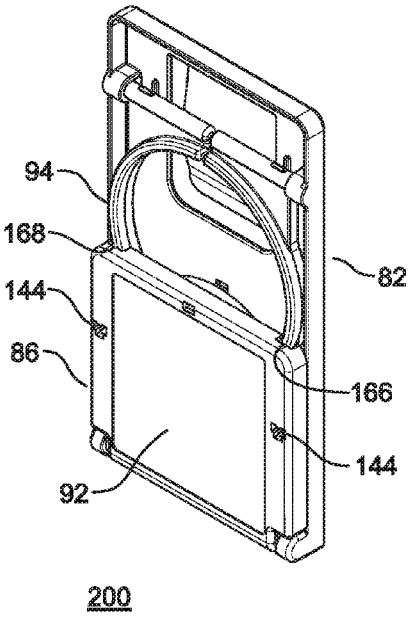
FIG. 14 is a perspective view of the embodiment shown in FIGS. 7-13 in a folded configuration.
Figure 15:
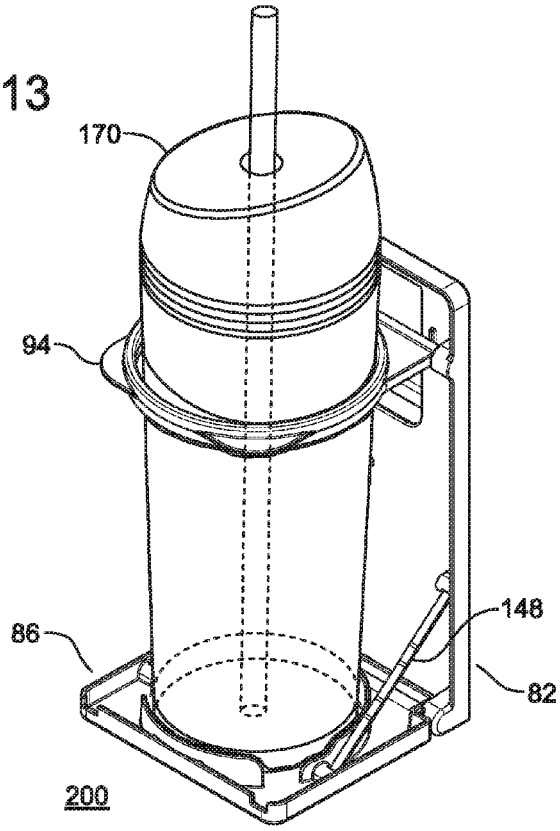
FIG. 15 is a perspective view of the embodiment shown in FIG. 14 in an open configuration supporting a beverage container.

Base panel 86 also includes extending upwardly from beverage receiving surface 90 a raised generally circular lip member 132 in which the lower end of a beverage container or bottle 134 is received (see FIG. 15) to inhibit the container from sliding laterally on surface 90. A pair of aligned cylindrically shaped retaining members 136 and 138 are also formed on base panel 86 along opposite side panels 114 and 116, respectively. In addition, a pair of similarly aligned retaining members 140 and 142 are provided on back panel 82 along opposite side panels 104 and 106, respectively. Members 136, 138, 140, and 142 each have an aperture 144 (see FIG. 14) in which an enlarged end portion of a flexible base panel support cable or line may be inserted to secure the cable extending between back panel 82 and base panel 86. More particularly, support cable 146 having enlarged end sections 147 (see FIG. 13) is secured extending between securing members 136 and 140, and support cable 148 is secured extending between securing members 138 and 142. Support cables 146 and 148 may be made of numerous conventional materials such as plastic, wire, or fabric cord material, and are sized so that when base panel 86 is pivoted outwardly as shown in FIGS. 7-8 and 15, and back panel 82 is oriented vertically, cables 146 and 148 prevent base panel 86 from pivoting past a generally horizontal position. Support cables 146 and 148 are strong enough to support the weight of a large drink container holding 24, 48, or 72 ounces, or even larger drinks carried in holding apparatus 200. In one embodiment shown in FIG. 13, enlarged end sections 147 are cylindrical to match the shape of apertures 144. In one embodiment, the cables are adjustable and can be easily replaced if they become broken or worn.

Beverage support member mounts 150 and 152 are provided on back panel 82 adjacent side panels 104 and 106 in a position spaced apart from mounts 122 and 124. Mounts 150 and 152 have inwardly facing openings 154 in which tabs 156 and 157 (see FIG. 12) on beverage support member 94 are inserted to pivotally connect the support member 94 to back panel 82. In one embodiment, beverage support member 94 is formed with a split 158 along the rearward edge of the holder portion. Member 94 is also formed of a resilient flexible material such as a thermoplastic that is sufficiently flexible such that the rear surface is pressed inwardly to insert the tabs 156 and 157 in mounts 150 and 152, after which the tabs 156 and 157 are caused to be continually urged outwardly in opposite directions into openings 154 in the mounts. Spacers 160 may be provided on inner surface 83 of back panel 82 which are aligned with small alignment tabs 161 on beverage support member 94 to aid in maintaining beverage support member 94 in proper alignment with respect to mounts 150 and 152.

Another tab 162 is provided on inner surface 83 of back panel 82, which tab 162 engages with slot 164 on the inner surface of ring 132 to hold base panel 86 and container holding member 94 in a folded or closed position when apparatus 200 is not in use. As shown in FIG. 14, small sections 166 and 168 of front panel 110 of base panel 86 are provided to accommodate beverage support member 94 and allow apparatus 200 to fold into an even more compact arrangement. FIG. 15 illustrates the apparatus 200 holding a large beverage container 170 with the lower end of the container supported on base panel 86, and an upper portion surrounded by support member 94. Cables 146 and 148 transfer the majority of the weight of container 170 from base panel 86 to back panel 82, and ultimately to the user who has the beverage container holding apparatus 200 secured to his or her belt buckle or the like using buckle member 96.

In known portable beverage holder arrangements where there is a single pivoting lower support panel, most if not all of the weight of the beverage is resting on the lower support, which weight and pressure is directed on the hinge mechanism or connection between the lower panel and a vertical or back panel, leading to significant wear and often early breakage or failure of this connection. In the described embodiments, however, a large amount of the weight of the beverage container rests either on the upper support panel 20 in embodiment 100 or the cables 146 and 148 in embodiment 200 and is redistributed to the back panel. This arrangement redirects and distributes a large amount of the downward force of the beverage container that would otherwise be directed on the hinges connecting the back panel and base panel, and further provides an overall stronger, more rigid support structure. While other beverage container holders have been adapted to hold larger sized and as a result heavier beverages, none of these holders has the additional advantage of being foldable into as compact and portable configuration as is possible with the present beverage support apparatus, which can be easily carried in a pocket, purse, bag, or the like and stored in a vehicle or home storage compartment without taking up much room.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A collapsible beverage container support apparatus comprising:

a back panel having top, bottom, and first and second lateral side walls each extending outwardly from a peripheral edge of the back panel and forming a shallow box-like configuration, and a pair of arms adjacent the bottom side wall having inwardly facing opposite apertures;

a base panel having a pair of outwardly directed tabs which are inserted in said inwardly facing opposite apertures to pivotally secure the base panel to the back panel, a raised portion to inhibit lateral movement of a beverage container placed on the base panel, and two lateral side walls and a front side wall extending from the base panel;

a clip mechanism secured to the back panel for securing the support apparatus to a belt or other clothing item;

a container support bracket pivotally secured to the back panel for engaging the side wall of a beverage container;

an additional fastener connecting between the base panel and back panel for transferring at least a portion of the weight of the beverage container from the base panel to the back panel; and a pair of cutouts on the front side wall of the base panel in which a portion of the container support bracket is received when the base panel and container support bracket are in a compact storage position, allowing for more compact folding of the apparatus.

2. The collapsible beverage container support apparatus of claim 1 in which said base panel and container support bracket are pivotal at least between the compact storage position in which the base panel and support bracket are aligned substantially in parallel with a longitudinal axis of the back panel, and a use position in which the base panel and container support bracket are aligned substantially at a right angle with respect to the longitudinal axis of the back panel.

3. The collapsible beverage container support apparatus of claim 2 in which said additional fastener includes at least one cable member connected on one end to a securing member attached to said base panel and connected on an opposite end to a securing member connected to said back panel, the cable member having an elongated cable section and a pair of enlarged end sections each having a tubular shape, and the securing members forming a cylindrical enclosure in which one of the enlarged end sections of the cable member is secured.

4. The collapsible beverage container support apparatus of claim 3 in which said additional fastener includes two cable members each connected to separate securing members on said base panel and back panel.

5. A collapsible beverage container support apparatus comprising:

a back panel having top, bottom, and first and second lateral side walls each extending outwardly from a peripheral edge of the back panel and forming a shallow box-like configuration, and a pair of arms adjacent the bottom side wall having inwardly facing opposite apertures;

a base panel having a pair of outwardly directed tabs which are inserted in said inwardly facing opposite apertures to pivotally secure the base panel to the back panel, and a raised portion to inhibit lateral movement of a beverage container placed on the base panel;

a clip mechanism secured to the back panel for securing the support apparatus to a belt or other clothing item;

a container support bracket pivotally secured to the back panel for engaging the side wall of a beverage container, wherein said base panel and container support bracket are pivotal at least between a compact storage position in which the base panel and support bracket are aligned substantially in parallel with a longitudinal axis of the back panel, and a use position in which the base panel and container support bracket are aligned substantially at a right angle with respect to the longitudinal axis of the back panel;

an additional fastener connecting between the base panel and back panel for transferring at least a portion of the weight of the beverage container from the base panel to the back panel; and an upper support panel pivotably connected to the base panel, said upper support panel being pivotable to a position juxtaposed on top of the base panel and being securable to said back panel.

6. The collapsible beverage container support apparatus of claim 5 further comprising one or more connectors provided on the back panel and one or more matching connectors aligned on the upper support panel for securing the upper support panel to the back panel.

7. The collapsible beverage container support apparatus of claim 6 in which the one or more connectors on the back panel are tab members and the one or more connectors on the upper support panel are slots aligned with the tab members whereby the upper support panel is pivotable to a position such that the tab members are received in the slots.

8. The beverage support apparatus of claim 7 in which the base panel and upper support panel are pivotable into a position whereby said panels are aligned side by side in the same plane.

9. The beverage support apparatus of claim 8 in which the base and upper support panels are pivotable into a position substantially parallel to the back panel and are lockable to the back panel in said position.

10. A collapsible beverage container holding apparatus comprising:

a back panel, said back panel have a front surface, a rear surface, side walls extending outwardly from peripheral edges of the front surface, and a retaining member located along each side wall;

a base panel pivotally secured to the back panel by a hinge connection, said base panel having a beverage support surface and an opposite surface, two lateral side walls and a front side wall, the side walls extending outwardly around the periphery of the beverage support surface, and a retaining member located along each side wall, each in alignment with one of the retaining members on the back panel;

a container support bracket pivotally secured to the back panel at a position spaced apart from the base panel, the base panel and container support bracket being pivotal at least between a compact storage position in which the beverage support surface of the base panel and the beverage support bracket are aligned substantially in parallel with the back panel, and a use position in which the beverage support surface of the base panel and the container support bracket are aligned substantially at a right angle with respect to the back panel;

a buckle member secured to the rear surface of the back panel; and the retaining members each forming an enclosure having an aperture in communication with an interior of said enclosure;

a pair of cable members each having a cable section and enlarged end sections which are securable in the enclosure of the retaining members with the cable section extending between aligned retaining members on the back panel and base panel, the cable members having a length such that when the holding apparatus is used to support a beverage container, at least some of the weight of the container on the base panel is transferred to the back panel by the cable members; and a pair of cutouts on the front side wall of the base panel in which a portion of the container support bracket is received when the base panel and container support bracket are in the compact storage position, allowing for more compact folding of the apparatus.

11. The collapsible beverage container holding apparatus of claim 10 in which the interior of the retaining member enclosures and outer surfaces of the enlarged end sections of the cable members each have a cylindrical shape.

12. The collapsible beverage container holding apparatus of claim 11 additionally comprising a pair of mounts on the back panel in which oppositely disposed tabs on the container support bracket are continually urged to pivotally connect the container support bracket to the back panel.

13. The collapsible beverage container holding apparatus of claim 12 additionally comprising a container alignment guide provided on the beverage support surface of the base panel to prevent lateral sliding of a container placed on the support surface.

14. The collapsible beverage container holding apparatus of claim 13 additionally comprising a slot in the base panel through which liquids on the container support surface can pass, said slot additionally aligned with a tab on the front surface of the back panel such that when the base panel is pivoted to the compact storage position the tab is engaged with said slot.

* * * * *